United States Patent [19]

Brenner et al.

[11] 4,430,871

[45] Feb. 14, 1984

[54] NEUTRAL PUMP-OUT FOR AUTOMATIC WASHER

[75] Inventors: Robert A. Brenner, St. Joseph Township, Berrien County; Thomas H. Buckleitner, Lincoln Township, Berrien County, both of Mich.

[73] Assignee: Whirlpool Corporation, Benton Harbor, Mich.

[21] Appl. No.: 452,284

[22] Filed: Dec. 22, 1982

[51] Int. Cl.[3] ..... D06F 37/40

[52] U.S. Cl. ..... 68/12 R; 68/23.7

[58] Field of Search ..... 68/12 R, 23.7

[56] References Cited

U.S. PATENT DOCUMENTS

| | | | |
|---|---|---|---|
| 3,197,982 | 8/1965 | Worst | 68/23 |
| 3,712,433 | 1/1973 | Thut | 172/28 |
| 4,038,841 | 8/1977 | Bright | 68/12 R |
| 4,218,899 | 8/1980 | Mason | 68/12 R |
| 4,231,237 | 11/1980 | Bochan | 68/23.7 |
| 4,283,928 | 8/1981 | Stone | 68/23.7 |
| 4,387,580 | 6/1983 | Kennedy et al. | 68/12 R |

*Primary Examiner*—Philip R. Coe
*Assistant Examiner*—Thomas W. Epting
*Attorney, Agent, or Firm*—Hill, Van Santen, Steadman & Simpson

[57] ABSTRACT

A means for operating a washing machine transmission in a neutral state is provided which includes a reversible drive gear for driving the transmission in a first agitate direction and an opposite spin direction. A drive pawl is pivotally mounted on the drive gear. Pawl pivoting means, being a circular control spring with an outwardly extending tang is selectively rotatable against either side of the pivoted pawl and a latching pawl selectively captures the tang when the drive gear is rotating in the spin direction to operate the transmission in a neutral state until the rotation of the spin gear is interrupted. Means are provided on the latch pawl to prevent relatching of the control spring if the rotation of the drive gear is subsequently interrupted.

11 Claims, 7 Drawing Figures

NEUTRAL PUMP-OUT FOR AUTOMATIC WASHER

BACKGROUND OF THE INVENTION

1. Field of the Invention

The present invention relates generally to automatic washing machines and more particularly to drive mechanisms for automatic washing machines.

2. Description of the Prior Art

An automatic washer spin delay mechanism is disclosed in U.S. Pat. No. 4,218,899 assigned to Whirlpool Corporation, the assignee of this application, in which a delay mechanism provides a delay in the spin cycle of an automatic washer which is operated by means of a pawl pivotable about a stud rotating on an eccentric, which in turn is engageable with a spin gear only in one direction of rotation, and thereby provides a delay of substantially one revolution of the eccentric upon a change in direction of rotation of the eccentric. The delay mechanism is utilized between an agitate portion of the wash cycle and a spin and pump-out portion of the wash cycle to allow for disengagement of rack and pinion means utilized to translate rotational movement of the motor to oscillatory movement of the agitator during the wash portion of the cycle. The oscillatory means must be disengaged so that the agitator is free to rotate with the basket at high speed during a spin portion of the cycle. During this period of time, the washing machine is filled with wash liquid when the basket and agitator begin to rotate in the spin mode.

In the washing process it has been found advantageous to pump wash and rinse liquid from the machine while the transmission is in an idle or neutral position, neither agitating nor spinning. This reduces loading on the machine's transmission and also has some advantages in alleviating redeposition of lint and soil from the wash and rinse water onto the laundered garments. In addition, the wrinkling of garments is reduced when the machine has been drained before spinning.

Thus, a means for shifting the transmission to an idle or neutral position while the wash liquid is being pumped from the wash tub, is required to gain the advantages listed above.

Several attempts have been made to provide a means to shift the drive mechanism of an automatic washer into neutral including solenoid operated shifter arm mechanism in U.S. Pat. No. 4,283,928, a rotary damping action in U.S. Pat. No. 4,231,237, a water level responsive delay mechanism in U.S. Pat. No. 4,038,841 and a centrifugal force mechanism delaying spin in U.S. Pat. No. 3,197,982.

SUMMARY OF THE INVENTION

An automatic washer of the present invention utilizes a single motor and drive mechanism to operate a vertical axis agitator and a clothes basket during washing and drying portions of a complete cycle. A rack and pinion means is provided to translate rotational movement of the motor to osillatory movement of the agitator during the wash portion of the cycle. The oscillatory means must be disengaged by means of a jaw clutch so that it is free to rotate with the basket at a high speed during a spin portion of the cycle. The jaw clutch is provided to cause engagement and disengagement of the oscillatory means with the agitator upon a change in direction of rotation of the motor. The disengagement means requires one complete rotation of a drive gear to ensure complete disengagement. In addition, it is found to be desirable to shift the transmission into a neutral or idle position in which the basket and agitator are neither spinning or agitating while the wash or rinse liquid are being pumped out of the washer tub. In accordance with the present invention, the transmission is shifted to an idle position for an amount of time sufficient to allow substantially all of the wash or rinse liquid to be pumped from the wash tub prior to initiation of the spinning mode. Also, means may be provided to ensure that the basket and agitator will remain in the spin mode if power is interrupted during the spin mode operation.

More specifically, a spring tang which rotates a drive pawl into a spin position when the main drive gear begins rotating in the spin direction, is prevented from engaging the drive pawl by being captured by a centrifugal latch mechanism. A first hook intercepts the tang which is mounted on the spin gear for rotation therewith, but which also can slip on the spin gear, such that the tang does not contact the drive pawl to pivot it into the spin position but rather allows it to remain in the neutral position.

After the liquid has been pumped from the washer tub, there is a pause provided by the automatic timer mechanism which allows the motor and main drive gear to come to rest. At this point the latch mechanism releases the tang which then rotates into contact with the drive pawl, pivoting it into the spin position. When power is resumed, the drive pawl engages an abutment on a spin gear to drive the spin gear and washer basket. If there is a power interruption during the spin cycle, such as occurs whenever the access lid is opened during spin, the coasting of the basket will cause the spin gear tang to move away from the drive pawl. To prevent the tang from being reintercepted by the latch mechanism upon reinstatement of power, there is provided a second hook on the latch mechanism to capture the tang to prevent excessive rotation relative to the latch mechanism. Restarting of the motor in a spin direction will cause the tang to pass the first hook of the latch mechanism and to again abut the drive pawl to pivot it into the spin position. If the motor is restarted in the agitate direction, the latch mechanism will release the tang and the tang will rotate in the opposite direction to contact an opposite side of the drive pawl to positively hold it in the agitate position.

DESCRIPTION OF THE PREFERRED EMBODIMENTS

Figure 1:
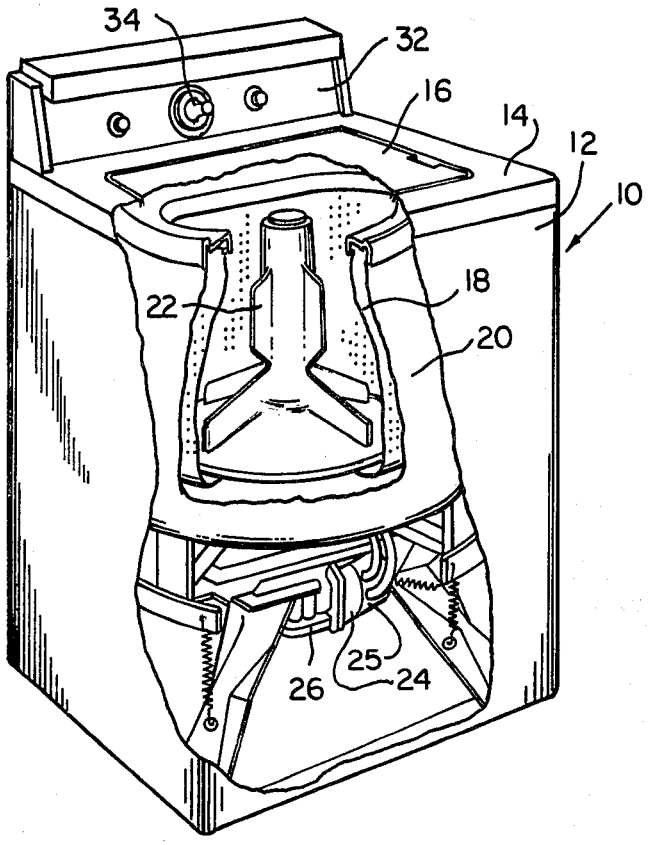
FIG. 1 is a perspective view, partially broken away, of an automatic laundry appliance embodying the present invention.

An automatic washing machine is generally illustrated in FIG. 1 at 10 and comprises a cabinet 12 with a top 14 and an openable lid 16 thereon. The lid 16 opens to provide access to the interior of a perforate wash basket 18 mounted concentrically within an imperforate wash tub 20.

A vertically mounted agitator 22 is carried within the wash basket 18 and is driven by an electric motor 24 operating through a transmission 26. The motor 24 also drives a water pump 25 for discharging wash liquid from the wash tub 20 to a drain (not shown).

The top 14 of the washing machine is provided with a console 32 which carries the user operated controls including a timer actuated control 34 used in selecting and operating the machine through a series of washing, rinsing and drying steps.

Figure 2:
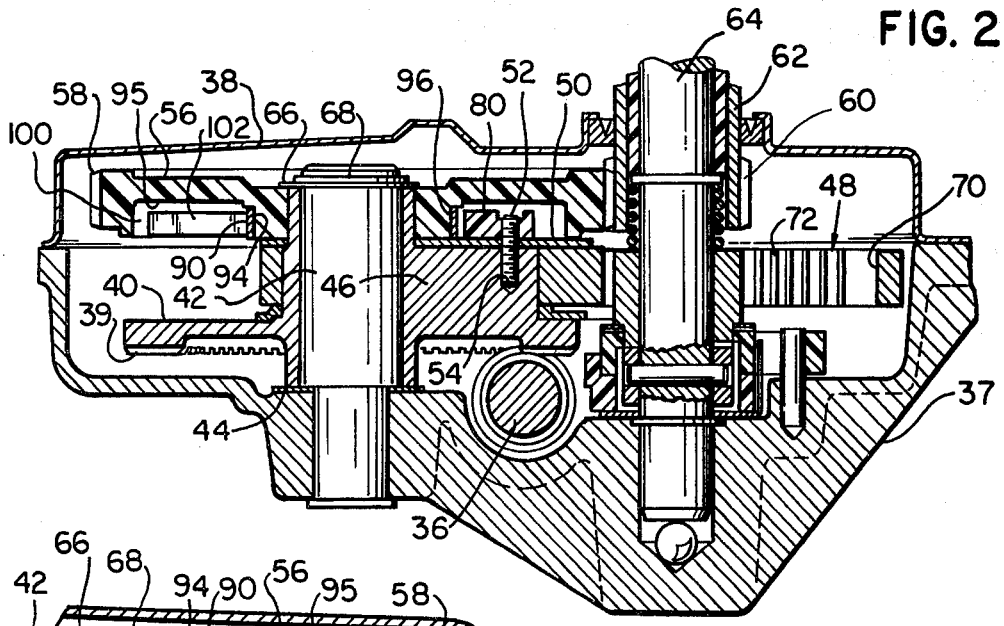
FIG. 2 is an enlarged sectional view of the clutch and spin delay mechanism taken generally along the lines II—II of FIG. 4.
Figure 4:
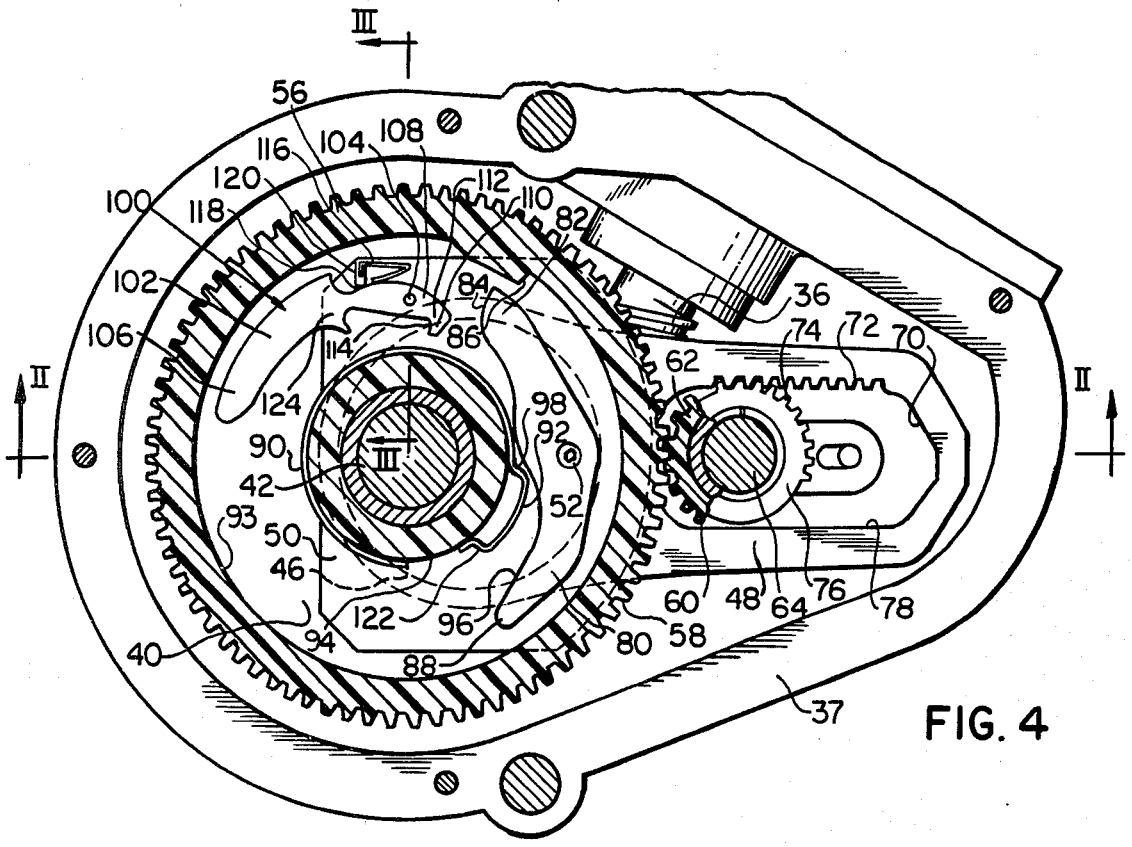
FIG. 4 is an enlarged sectional view of the clutch and spin delay mechanism of the laundry appliance of FIG. 1 in the agitate position.

Referring to FIGS. 2 and 4, a worm gear 36 is carried on one end of a drive shaft (not shown), the other end of which is connected to the motor 24 (FIG. 1). The worm gear 36 is disposed within a transmission housing 37 including a gear case cover 38 and engages teeth 39 disposed circumferentially on a lower surface of a main drive gear 40. The drive gear 40 is rotatably mounted on a jack shaft 42 and rests on a bearing washer 44. An upper portion of the drive gear 40 has an eccentric 46 integrally formed thereon. One end of a rack 48 has an opening for receiving the eccentric and operates in slidable movement therewith. A bearing plate 50 is positioned above the rack 48 on the eccentric 46 and held in place by a stud 52 which is received in a receptacle 54 in the eccentric 46. Mounted above the bearing plate 50 and concentric with the drive gear 40 is a spin gear 56 having teeth 58 which engage teeth 60 on a spin pinion 62 rotatable about agitator shaft 64. All elements mounted on the jack shaft 42 are maintained in adjacent relation by a washer 66 which is held in place by a snap ring 68.

An opposite end of the rack 48 has a loop 70 which surrounds the agitator shaft 64. A row of teeth 72 are formed on one side of the loop 70 and engage teeth 74 formed on a portion of the exterior of an agitate pinion 76 rotatably mounted about the agitator shaft 64. The side of the loop 70 opposite the teeth 72 has a smooth bearing surface 78 movable against a portion of the exterior of the pinion 76 having no teeth thereon, thereby ensuring complete engagement of the teeth 74 on the agitate pinion and the teeth 72 on the rack. As the eccentric 46 is rotated by the main gear 40, a reciprocal motion in a plane normal to the agitator shaft 64 is imparted to the rack 48. This reciprocatory motion is transferred to the agitate pinion 76 by means of engagement of the teeth 72 and 74, causing the oscillatory motion in the agitate pinion. This oscillatory motion is then transferred to the agitator shaft 64 through a jaw clutch means as described and disclosed in U.S. Pat. No. 4,218,899 which is incorporated herein by reference.

Figure 6:
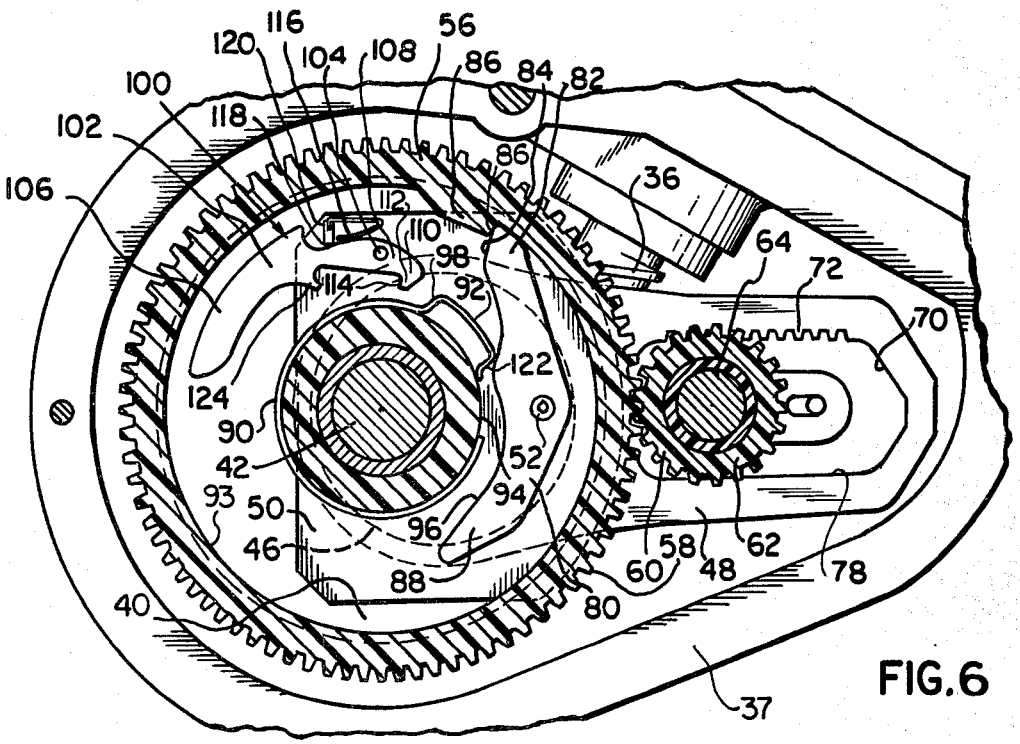
FIG. 6 is a sectional view similar to that shown in FIG. 5 with the mechanism in the spin position.

As seen in FIGS. 2 and 4, there is a drive pawl 80 pivotally mounted on the stud 52 for corotation with the drive gear 40 about the jack shaft 42. The pawl 80 has a first end 82 having an angled surface 84 which is capable of drivingly engaging an abutment 86 on an outer wall 93 of an annular channel 95 formed in the lower side of the spin gear 56 when the drive pawl 80 is pivoted into a spin position such as shown in FIG. 6. A second end 88 of the drive pawl 80 is provided in a size and shape to prevent pivotal movement of the drive pawl when the drive gear 40 is rotated at high speeds. The second end 88 is shaped to provide a clearance with the abutment 86 when the drive pawl 80 and drive gear 40 rotate in the clockwise agitate direction relative to the stationary spin gear 56.

A control spring 90 having a radially outwardly extending tang 92 is fitted around an inner wall 94 of an annular channel 95. The control spring 90 is slidingly mounted on the inner wall 94 such that a rotating force supplied to the control spring 90 via the tang 92 will not cause rotation of the spin gear 56.

As the drive gear 40 rotates in the clockwise agitate direction, an inner surface 96 on the inwardly extending portion of the drive pawl 80 contacts a first edge 98 of the tang 92 which causes the drive pawl 80 to pivot about stud 52 in a counterclockwise direction. This pivoting action moves the second end 82 of the drive pawl radially inwardly so that it will clear the abutment 86 on the spin gear 56. As the drive pawl 80 mounted on the drive gear 40 continues to rotate in a clockwise direction around the jack shaft 42, the control spring 90 and tang 92 are caused to slide on the surface 94 of the spin gear without causing the spin gear itself to rotate.

Figure 3:
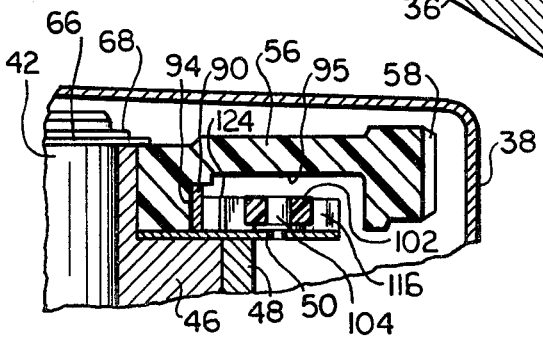
FIG. 3 is an enlarged partial sectional view of the second pawl mechanism taken generally along the lines III—III of FIG. 4.

Upon reversal of the drive motor 24, the transmission mechanism would normally shift into a spin position in accordance with the teachings of U.S. Pat. No. 4,218,899. However, it has been found desirable to shift the transmission into a neutral or pause position to allow the water pump 25 to substantially drain tub 20 before the basket 18 is rotated to centrifuge the laundry. There is provided a latch mechanism designated generally at 100 in FIGS. 2 through 7 which is comprised of a latch pawl 102 pivotally mounted by means of a pivot pin 104 (FIG. 3) to the bearing plate 50 which is secured for rotation to the eccentric 46 of the drive gear 40. The latch pawl 102 is pivotally mounted in an off-center manner such that a first end 106 extends a greater distance from the pivot pin 104 and contains more mass than a second end 108. The second end 108 has a first hook portion 110 associated therewith which comprises a radially inwardly extending nose portion 112 and an abutment surface 114. A spring mounting member 120 mounts a return spring 116 on the bearing plate 50. The spring 116 engages an outer wall 118 on the first end 106 side of the pivot pin 104. This return spring 116 biases the latch pawl 102 in a counterclockwise direction about pivot pin 104.

As the latch pawl 102 rotates with the rotating drive gear 40, centrifugal force acting on the relatively massive and extending first end 106 of the latch pawl 102 causes the latch pawl to pivot in a clockwise manner about pivot pin 104 overcoming the bias of the return spring 116. The spring mounting means 120 forms a stop member radially outwardly from the latch pawl 102 to provide a limit on the pivotal movement of the latch pawl 102. This ensures that the outer surface 118 of the latch pawl 102 will not contact the abutment 86 on the spin gear 56 as the drive gear 40 rotates relative to the spin gear.

As seen in FIG. 4, when the drive gear 40 is rotating in the clockwise agitate direction, the tang 92 of the control spring 90 is contacted at edge 98 by the inner surface 96 of the drive pawl 80 which urges the drive pawl 80 to rotate counterclockwise about stud 52 into a neutral position not driving the spin gear 56. When the motor is shifted to the opposite spin and pump-out direction, the drive gear 40 rotates in a counterclockwise direction thereby resulting in the drive pawl 80 moving away from the tang 92 of the control spring 90. This occurs because the control spring 90 is mounted on the spin gear 56 which remains stationary.

Figure 5:
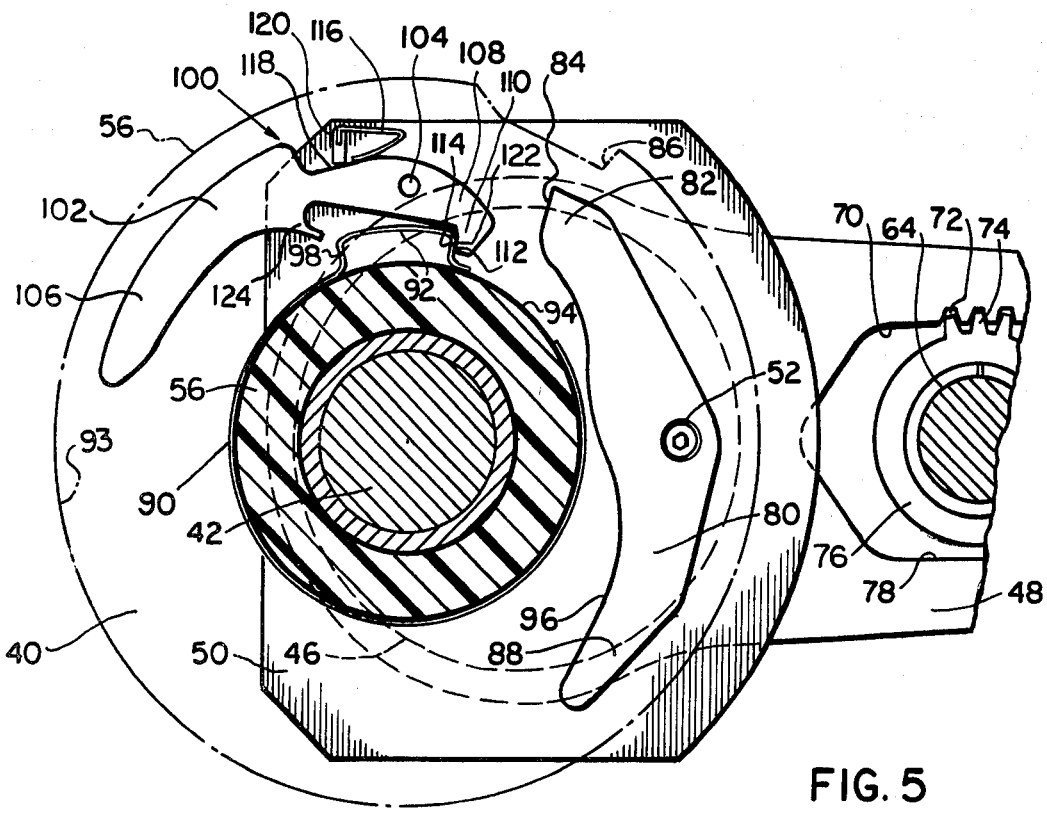
FIG. 5 is an enlarged partial sectional view of the pawl mechanism of FIG. 4 in the latched or pump-out position.

As the drive gear 40 begins moving in the counterclockwise spin direction, centrifugal force acts on the first end 106 of the latch pawl 102 urging it outward and thereby causing the first hook portion 110 to be pivoted inwardly. As the drive gear 40 continues its rotation, the abutment surface 114 of the first hook 110 comes into contact with a second edge 122 of the tang 92 as seen in FIG. 5. The hook 110 positively intercepts the tang 92 and thereby prevents it from contacting the second end 82 of the drive pawl 80 which could cause it to move into the spin position. In this manner, the drive pawl 80 remains in the neutral position as is shown in FIG. 5 and the control spring 90 and tang 92 are caused to slide on the surface 94 of the spin gear 56 without rotating the spin gear. Thus, the pump is able to pump wash liquid from the wash tub without the basket 18 spinning.

The timer mechanism 34 is provided with pause at the end of the pump-out portion of the wash cycle to allow the motor 24 and main drive gear 40 to come to rest. Due to the force of the return spring 116 and since the frictional torque on the spin gear spring 90 is basically constant with velocity, a trip point occurs during deceleration of the main drive gear 40 which forces the latch pawl 102 to pivot in a counterclockwise direction about pin 104 thereby disengaging the hook portion 110 from the end 122 of the tang 92. This results in the drive pawl 80 rotating into contact with end 122 of the tang 92 causing the first end 82 of the drive pawl 80 to be rotated radially outwardly.

Upon restarting the motor in the spin direction, the first end 82 of the drive pawl 80 will be rotated into contact with the abutment 86 such that the abutment surface 84 of the drive pawl 80 drivingly engages the abutment 86 and drives the spin gear 56 and thus the basket 18 in a rotary manner (FIG. 6). In this mode, the drive gear 40 and spin gear 56 are corotating about the jack shaft 42 by means of the connection of the drive pawl 80.

Figure 7:
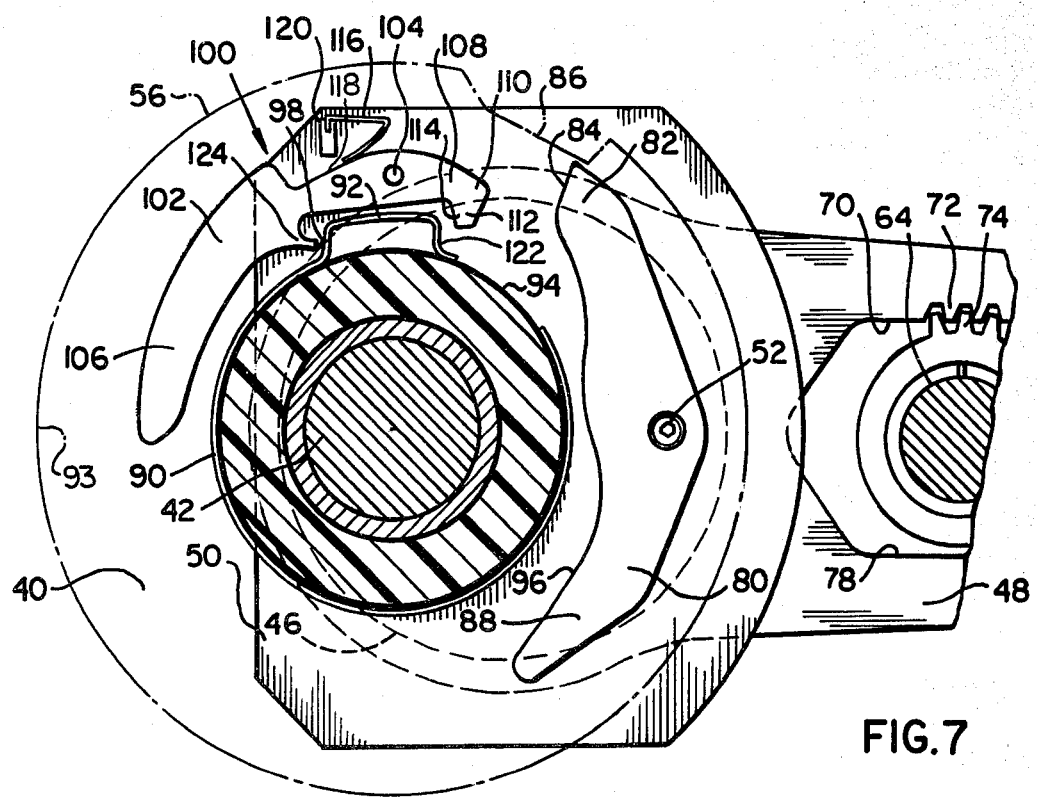
FIG. 7 is a sectional view similar to that shown in FIG. 5 with the mechanism in the spin interrupted position.

If there is a power interruption to the motor 24 during the spinning portion of wash cycle, as would occur if lid 16 were opened, it has been found that the basket 18 and spin gear 56 will continue to coast after the drive gear 40 has stopped. This results in the control spring 90 and tang 92 rotating in a counterclockwise direction away from the drive pawl 80. As the basket, and thus spin gear 56 make one revolution, the abutment 86 would push against the first end 82 of the drive pawl 80 causing it to pivot in a counterclockwise direction and thus into the neutral position. To prevent the transmission from operating in the neutral position after power to the motor has been reinstated during the spin portion of the cycle, a second hook means 124 is provided on the latch pawl 102 on the first end 106 side of the pivot pin 104 but sufficiently close to the first hook 110 such that the second end 122 of the tang 92 will be closely adjacent the first hook 110. With the return spring 116 urging the latch pawl 102 in a counterclockwise pivotal direction about pivot pin 104, the tang 92 is positively captured by the second hook 124 as the second hook 124 contacts the first edge 98 of the tang as seen in FIG. 7.

If power to the motor is restarted in the spin direction, the rounded portion of the second edge 122 of the tang 92 will contact the nose portion 112 of the first hook 110 thereby permitting the tang 92 to pass the first hook portion 110 before sufficient centrifugal force operates on the latch pawl 102 to pivot the latch pawl 102 in a clockwise direction to an intercept position. Thus, the drive pawl 80 will be rotated into contact with the second end 122 of the tang 92 and will be pivoted again into the spin position as shown in FIG. 6. In this manner, the transmission will be prevented from remaining in the neutral position after interruption during the spin portion of the cycle.

If the motor is restarted in the agitate direction after power interruption during the spin portion of the cycle, the drive gear 40 will begin rotating in the clockwise direction and as its speed builds, centrifugal force will act on the latch pawl 102 causing the first end 106 to pivot radially outwardly thereby releasing the second hook 124 from the first edge 98 of the tang 92. Then as the drive gear 40 continues to rotate, the interior surface 96 of the drive pawl 80 will contact the first edge 98 of the tang 92 at the second end 88 of the drive pawl 80 to positively pivot the drive pawl 80 into the agitate and neutral position. Thus, there will be sufficient clearance between the drive pawl 80 and the abutment 86 on the spin gear 56 to prevent rotation of the spin gear. In this manner, the transmission will operate in the agitate direction as is shown in FIG. 4.

In this manner, the transmission can be operated in a neutral position to provide a pump-out portion of a wash cycle and the transmission is prevented from returning to the neutral position after a power interruption during a spin portion of the wash cycle by the utilization of only a drive pawl and a latch pawl, additional parts and mechanisms not being necessary.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic laundry appliance, including:

a tub for receiving wash liquid, a receptacle within said tub for receiving a clothes load, a motor selectively coupled to a first drive means in a first directiion of rotation for agitating a clothes load and in a second direction of rotation to a second drive means for spinning said receptacle containing said clothes load, a pump means driven by said motor for removing said wash liquid from said tub, a presettable sequential control means for controlling a cycle of operation including a period when said first drive means is decoupled followed by a period when said second drive means is coupled to said motor, a delay means for delaying coupling of said second drive means until said pump means has removed a quantity of said wash liquid from said tub, said delay means comprising:

an automatically actuatable rotating engagement means for drivingly engaging said second drive means; and latch means preventing engagement of said engagement means with said second drive means after said engagement means has been automatically actuated by rotation of said motor in said second direction until said control means interrupts said motor operation in said second direction, said latch means including means to capture said engagement means upon subsequent interruption of said motor operation in said second direction permitting re-engagement of said engagement means with said second drive means upon resumption of said motor operation in said second direction.

2. The appliance of claim 1 wherein said latch means comprises a latch pawl having a first hook portion to intercept said engagement means rotating in said first direction and a second hook portion to capture said engagement means upon subsequent interruption of said motor operation in said second direction permitting re-engagement of said engagement means with said second drive means upon resumption of said motor operation in said second direction.

3. In a transmission for an automatic washer operable in a first and second direction, means for operating said transmission in a neutral state comprising:

a drive gear mounted on a shaft for rotation;

means for driving said drive gear in a first and a second rotational direction;

drive pawl means pivotally mounted on said drive gear for rotation therewith;

said pawl means pivotable between a first and second position;

a spin gear mounted on said shaft for rotation;

rotatable means for pivoting said pawl means to said first position when said drive gear is rotating in said first direction and to said second position when said drive gear is rotating in said second direction;

means associated with said drive pawl means and said spin gear when said pawl means is in said second position to cause said pawl means to drive said spin gear in said second rotational direction;

latch pawl means to intercept said rotatable means rotating in said second rotational direction to prevent said rotatable means from pivoting said pawl means to said second position until said drive gear is interrupted from rotating in said second direction; and said latch pawl means including means to capture said rotatable means upon subsequent interruption of said rotation of said drive gear in said second direction permitting said rotatable means to repivot said pawl means to said second position upon resumption of rotation of said drive gear in said second direction.

4. The device of claim 3 wherein said rotatable means comprises a control spring means slidably mounted on said spin gear.

5. The device of claim 3 wherein said latch pawl means includes a first hook portion to intercept said rotatable means rotating in said second direction and a second spaced hook portion to capture said rotatable means upon subsequent interruption of said drive gear second direction rotation.

6. The device of claim 5 wherein said rotatable member comprises a control spring means slidably mounted on said spin gear and having an outwardly extending tang portion capturable by said hook portions.

7. The device of claim 6 wherein said tang is elongated to essentially fill the space between said hook portions.

8. The device of claim 7 wherein said latch pawl is mounted to be pivotable from a first position to a second position by means of centrifugal force.

9. The device of claim 8 wherein said latch pawl is operable to intercept said tang rotating in said second direction when said latch pawl is in said second position.

10. The device of claim 9 wherein said latch pawl is operable to capture said tang in said first position.

11. The device of claim 10 including spring return means biasing said latch pawl means toward said first position.

* * * * *